US006684543B2

(12) United States Patent
Fernau

(10) Patent No.: US 6,684,543 B2
(45) Date of Patent: Feb. 3, 2004

(54) SHOE MOUNTED IDENTIFICATION ASSEMBLY AND METHOD

(76) Inventor: Mary Lynn Fernau, 2705 Maple La., Pearland, TX (US) 77584

( * ) Notice: Subject to any disclaimer, the term of this patent is extended or adjusted under 35 U.S.C. 154(b) by 0 days.

(21) Appl. No.: 10/167,137

(22) Filed: Jun. 11, 2002

(65) Prior Publication Data

US 2003/0226301 A1 Dec. 11, 2003

(51) Int. Cl.[7] ..... G09F 23/00

(52) U.S. Cl. ..... 40/636; 24/3.2; 36/132; 36/136

(58) Field of Search ..... 40/636, 633; 24/3.2; 36/132, 136; D20/27

(56) References Cited

U.S. PATENT DOCUMENTS

| | | | | |
|---|---|---|---|---|
| 3,106,028 A | | 10/1963 | Baumgartner | |
| 3,473,198 A | | 10/1969 | Meier | |
| 4,239,136 A | | 12/1980 | Godwin | |
| 4,254,566 A | * | 3/1981 | Haskell | 40/636 |
| 4,327,512 A | * | 5/1982 | Oliver | 40/636 |
| 4,341,331 A | | 7/1982 | McDougall | |
| 4,489,867 A | | 12/1984 | Schwemberger | |
| 4,507,882 A | * | 4/1985 | Harrell | 36/136 |
| 4,536,975 A | * | 8/1985 | Harrell | 36/136 |
| 4,571,854 A | | 2/1986 | Edens | |
| 4,897,947 A | * | 2/1990 | Kass-Pious | 40/636 |
| 4,955,150 A | * | 9/1990 | Fagan | 36/136 |
| 4,999,888 A | | 3/1991 | Miller | |
| 5,002,212 A | | 3/1991 | Charleton | |
| 5,022,127 A | | 6/1991 | Ang | |
| 5,042,119 A | | 8/1991 | Williams | |
| 5,283,969 A | | 2/1994 | Weiss | |
| 5,351,370 A | | 10/1994 | Fields et al. | |

(List continued on next page.)

OTHER PUBLICATIONS

Internet Advertisement for Child Identification Wristbands, Tags & Cards: Childs ID, Inc. PO Box 428 Round Lake, IL : www.childsid.com/generic/html?pid=29.

Internet Advertisement for Safe–Card Identification Services, 4801 E Independence, Suite 705, Charlotte, NC Feb. 21, 2002, Internet Address: www.safecardid.com/childid.shtml.

Internet Advertisement for "Shoe Tags" Merchant: Kids Central Station, Inc. Feb. 21, 2002, Internet Address: www.kidscentralstation.com/idproductsuse/tags/tags.html.

Internet Advertisement for "Safe Shoes ID" Merchant Address: 304 Birch Drive, Lafayette, LA, Date Feb. 21, 2002, Internet Address: www.yoursafechild.com/ss.htm.

*Primary Examiner*—Gary Hoge
(74) *Attorney, Agent, or Firm*—Kenneth L. Nash

(57) ABSTRACT

A shoe mounted emergency identification information carrying assembly and method are provided. In a preferred embodiment, one or more members are provided to loop around shoe components such as the shoe tongue, laces, latches, or the like. The one or more members are preferably affixed together to form a looping member that can be inserted underneath the shoe components and then over the shoe components. In one embodiment, the one or more members may be affixed together at an overlap region such that the opposite sides of the overlap region are secured and the inner portion thereof can be opened to receive or loop around one or more shoe components, straps, or buckles. At least one fastener is also provided to fix the looping member in position around the shoe components by forming a closed loop. An interior surface of the looping member is not visible once the closed loop is formed and a detailed emergency identification information label is positioned there. An outer surface of the looping member is visible and supports a label that indicates emergency identification information is carried by the looping member.

19 Claims, 4 Drawing Sheets

U.S. PATENT DOCUMENTS

| | | | | | |
|---|---|---|---|---|---|
| 5,380,046 | A | | 1/1995 | Stephens | |
| D356,599 | S | * | 3/1995 | Ashner | D20/27 |
| 5,459,947 | A | * | 10/1995 | Lasher | 36/136 |
| D373,750 | S | | 9/1996 | Gunderson | |
| 5,775,011 | A | * | 7/1998 | Reitano, Jr. | 36/136 |
| 5,913,483 | A | | 6/1999 | Polk | |
| D412,937 | S | | 8/1999 | Franklin | |
| 5,967,559 | A | | 10/1999 | Abramowitz | |
| 6,000,111 | A | | 12/1999 | Deskins et al. | |
| 6,055,756 | A | | 5/2000 | Aoki | |
| 6,349,493 | B1 | | 2/2002 | Newman et al. | |
| 6,449,881 | B1 | * | 9/2002 | Assaf et al. | 36/136 |

* cited by examiner

SHOE MOUNTED IDENTIFICATION ASSEMBLY AND METHOD

TECHNICAL FIELD

The present invention relates generally to emergency identification and, more particularly, to a shoe mounted identification assembly.

BACKGROUND ART

Emergency identification bands are well known. However, especially for use with small children, presently existing identification bands tend to have problems related thereto. Having to put an identification band on each time the child goes out is inconvenient. As well, the band may then be easily forgotten or even misplaced. Children will often attempt to remove identification bands worn on the wrist, as a necklace, or the like. Such items are also easily snagged on various objects so as to produce a risk of injury or other problems. Identification cards and the like are easily lost and not readily found if a young child, who cannot speak, becomes lost.

Identification means for children attached to the shoe have been used in the past but these also have problems. For instance, in the prior art, the identification is used inside the shoe and may not be readily found, if at all. If a child cannot speak, he may not know even know the identification information is there. A child may also easily forget the identification is there if he cannot see it. Externally mounted tags mounted to the shoe have been utilized but can only be utilized on particular types of shoes. If that particular type of shoe is not used, then the tag cannot be used. Moreover, externally mounted prior art identification tags for the shoes are difficult to get on and off. When changing shoes, the tag may not be used due to the significant time and effort required, and with the child fidgeting, thereby defeating the entire purpose of the tag. As well, prior art externally mounted tags are difficult to utilize quickly for providing identification information without causing additional consternation to a lost child.

Consequently, there remains a need to provide an improved shoe mounted identification to solve the aforementioned problems for children as well as other groups of persons who may have trouble identifying themselves such as autistic children, Alzheimer patients, and the like. Those of skill in the art will appreciate the present invention which addresses the above and other problems.

SUMMARY OF THE INVENTION

An objective of the present invention is to provide an improved emergency information carrier assembly.

Another objective of an embodiment of this invention is to provide an improved emergency information carrier assembly that may be secured to various possible components of many different types of shoes.

These and other objectives, features, and advantages of the present invention will become apparent from the drawings, the descriptions given herein, and the appended claims. However, it will be understood that above-listed objectives and/or advantages of the invention are intended only as an aid in quickly understanding aspects of the invention, are not intended to limit the invention in any way, and therefore do not form a comprehensive or restrictive list of objectives, and/or features, and/or advantages.

Accordingly, the invention provides, in one embodiment thereof, a shoe mounted information carrying assembly for mounting on a plurality of shoe latches, shoe tongues, shoe laces, or other components thereof. While the preferred method of use is with shoes, the present invention may also be utilized on wrists, belt loops, purses, etc. Shoe components to which the invention may be attached may include laces, straps, shoe tongue, other fasteners, and/or other features. The assembly may comprise one or more elements such as, for example, one or more members for looping around the upper side and the lower side of the one or more shoe components to form a closed loop around the one or more shoe components for mounting to the shoe and/or at least one fastener for securing the one or more members to provide that the closed loop is latched in a closed position for secure attachment to the shoe and/or an information label mounted to the one or more members on an inner surface of the closed loop to provide detailed information about the wearer and/or an outer label on an outer surface of the one more members mounted so as to be positioned above the upper side of the one or more shoe components. The outer label identifies the shoe mounted information carrying assembly as providing information related to the wearer.

The fastener may comprise a hook and loop fastener. The one or more members may comprise at least two flexible members permanently secured together to form a single member. The one or more members may be permanently secured together to form a doubled region centrally positioned in the single member. The doubled region may be mountable along an upper side of the one or more shoe components. The outer label may be formed on an outer surface of the doubled region.

The present invention also provides a method for providing emergency information on a shoe of a wearer and may comprise one or more method steps such as, for instance, looping one or more members around an upper side and a lower side of a one or more shoe components of the shoe such that an outer surface of the one or more members is visible above the one or more shoe components and an inner surface of the one or more members is not visible. Other steps may comprise latchably affixing the one or more members in position and/or providing emergency information on the inner surface of the one or more members whereby the emergency information is visible upon unlatching the one or more members to expose the inner surface.

The method may further comprise providing a label on the visible outer surface of the one or more members to indicate that emergency information is contained therein. The step of latchably affixing may further comprise utilizing one or more hook and loop fasteners to affix the one or more members to the shoe.

The method may further comprise permanently securing at least two members together to form a single looping member and/or providing that a first of the at least two members have one side that is substantially covered with hooking fasteners and/or providing a second of the at least two members have one side that is substantially covered with looping fasteners.

The step of permanently securing the at least two members may further comprise applying glue and/or ultrasonic welding to a portion of the hooking fasteners and the looping fasteners and interconnecting the hooking fasteners and the looping fasteners.

The method may further comprise forming a doubled portion in a central portion of the single looping member and/or positioning the doubled portion directly above or directly below the one or more shoe components and/or providing that the one or more shoe components are comprised of shoe laces, buckles, or straps.

Another embodiment of the invention may comprise one or more elements such as, for example, at least two members wherein a first member of the at least two members may have a plurality of hook fasteners on one side thereof and a second member of the at least two members may have a plurality of loop fasteners on one side thereof. A permanent interconnection may be provided between the first member and the second member to form a single looping member operable for looping around the upper side and lower side of suitable shoe components to form a closed loop around the shoe components for mounting to the shoe. However, the permanent interconnection may also be provided with connections on each end of the permanent connection that permits opening thereof that may fit around a shoe strap so that the invention may remain secured to the shoe strap even when the strap is opened. The single looping member may typically have an outer surface and an inner surface. The permanent interconnection may be comprised of overlapping portions of the loop fasteners and hook fasteners and may be positioned in a middle region of the single looping member. A detailed information label may be mounted to the inner surface of the single looping member to provide detailed information about the wearer. The single looping member may be substantially flexible.

An outer label may be provided on the outer surface of the single looping member so as to be visible above the shoe to provide notification of the detailed information carried by the assembly.

This summary is not intended to be a limitation with respect to the features of the invention as claimed, and this and other objects can be more readily observed and understood in the detailed description of the preferred embodiment and in the claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

While the present invention will be described in connection with presently preferred embodiments, it will be understood that it is not intended to limit the invention to those embodiments. On the contrary, it is intended to cover all alternatives, modifications, and equivalents included within the spirit of the invention.

GENERAL DESCRIPTION OF PREFERRED EMBODIMENTS FOR CARRYING OUT THE INVENTION

Figure 1:
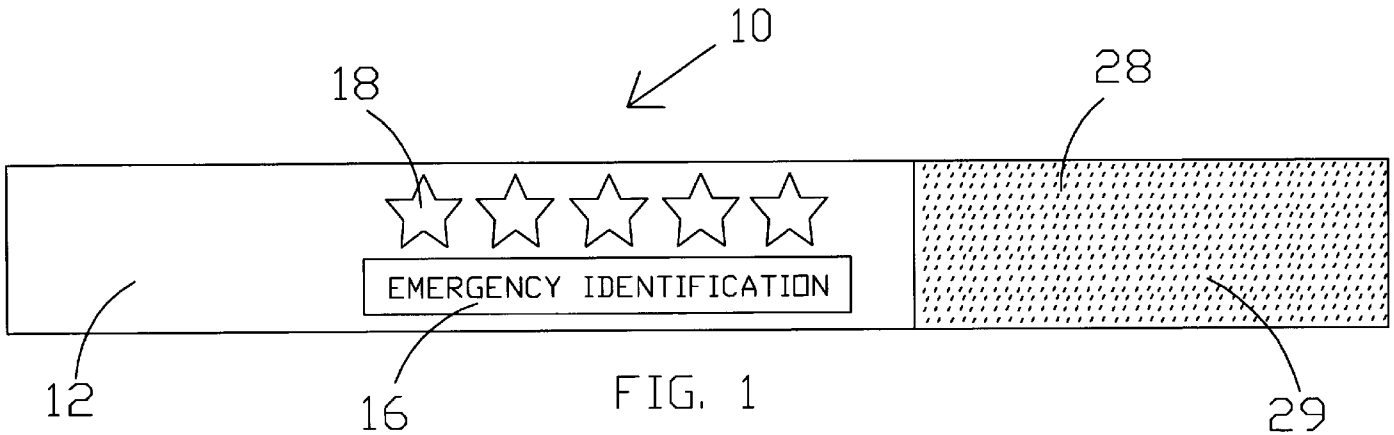
FIG. 1 is a top view showing a shoe mountable identification assembly in accord with the present invention.
Figure 2:
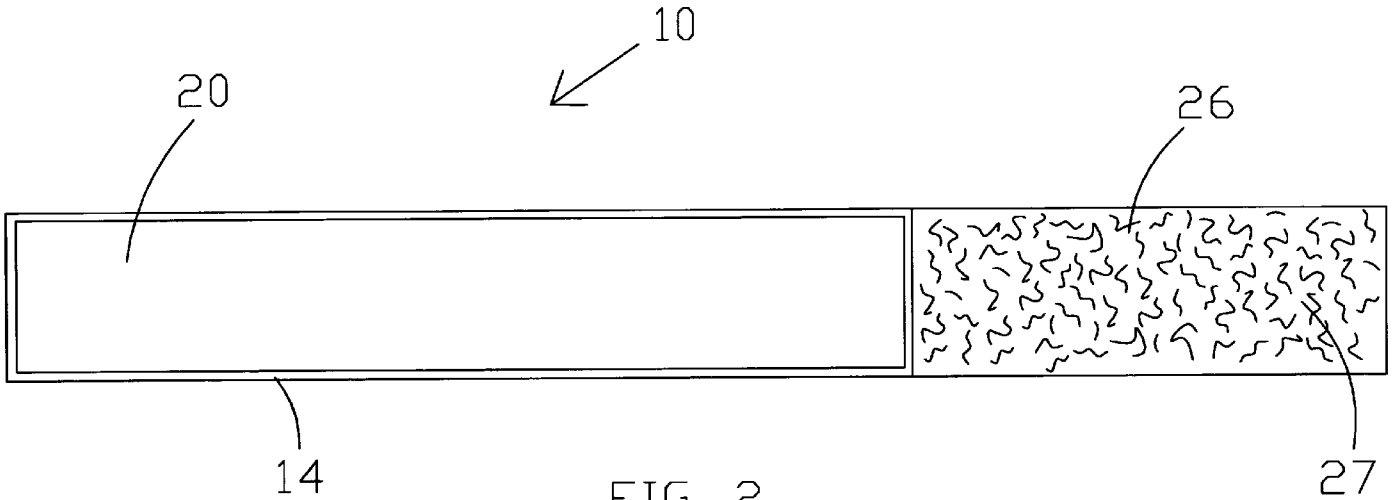
FIG. 2 is a bottom view of the shoe mountable identification assembly in accord with the present invention.

Referring now to the drawings and, more particularly to FIG. 1 and FIG. 2, there is shown a presently preferred embodiment of shoe mounted identification assembly 10. Shoe mounted identification assembly 10, in a presently preferred embodiment, comprises interconnected upper strip 12 and lower strip 14. This presently preferred construction is very simple and yet highly effective. However, other possible constructions, some of which are discussed below, may also be utilized to perform the method of the invention.

Upper strip 12 has label 16 that identifies upper strip 12 as containing emergency identification, emergency information, medical information, or other types of information. Upper strip 12 may also utilize various types of pictures 18, and the like, that may be enjoyable for children. In a preferred embodiment, bold colors such as luminescent green and orange or other colors may be utilized.

Figure 3:
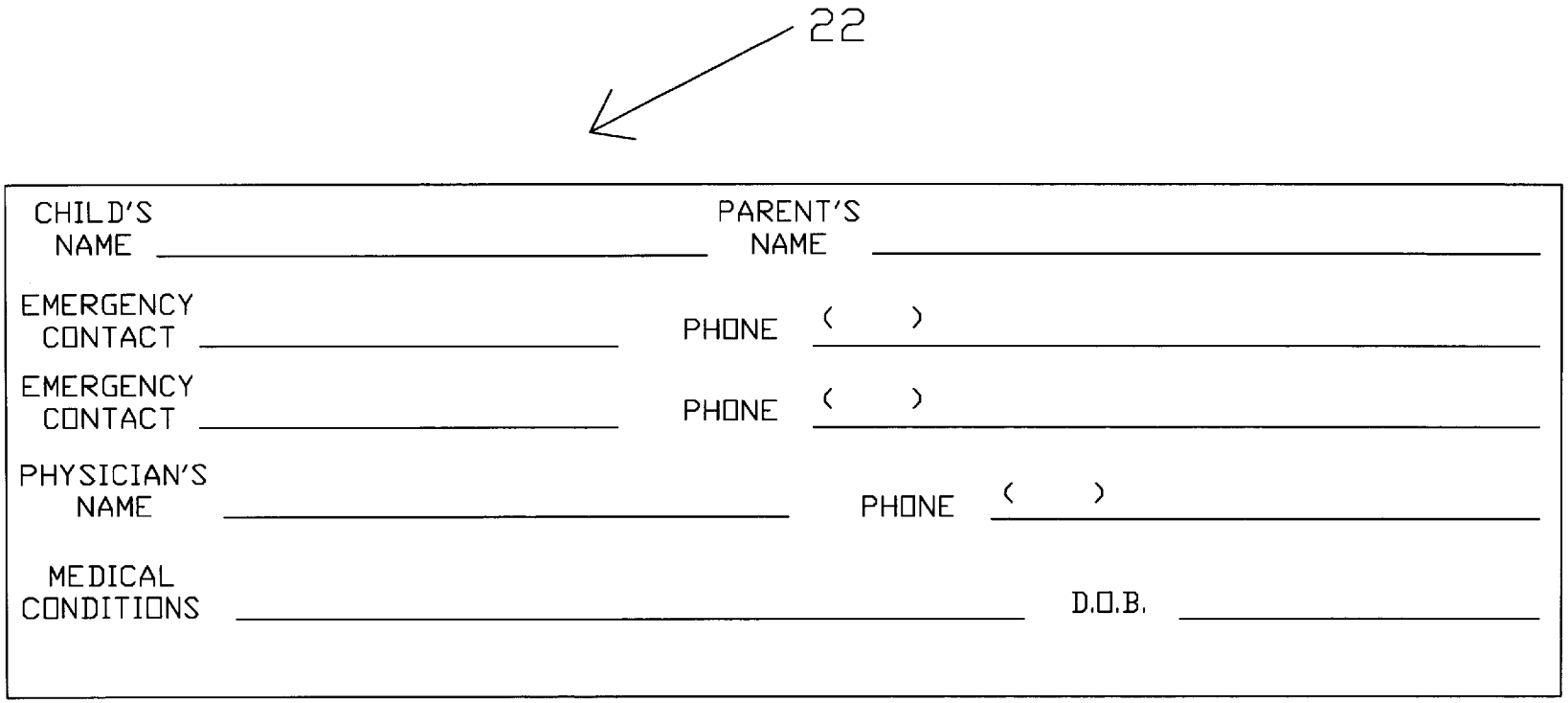
FIG. 3 is an elevational view showing one possible identification information insert for the shoe mountable identification assembly in accord with the present invention.

Identification receptacle 20, which is not visible when assembly 10 is secured to the shoe, provides a suitable holder for emergency identification strip, tag, or label 22, or the like, as shown in FIG. 3. Any suitable material or construction to provide a strip, tag, label, sign, or other readable means may be utilized to form emergency identification label 22. Identification receptacle 20 may simply be a blank portion for receiving identification label 22 or could comprise a plastic pocket or other means for receiving and holding identification strip, tag, or label 22. Likewise, identification strip, tag, or label 22 may be removable but could also be affixed such as with glue, ultrasonic welding, or other means to identification receptacle 20. Various types of information could be included such as phone numbers, addresses, contact names, and the like. If desired, bar codes or other machine readable means could be included. As well, numbers of a subscription service or the like that keep a 24-hour operator available may be provided whereby the operator has emergency information and instructions.

Figure 4:
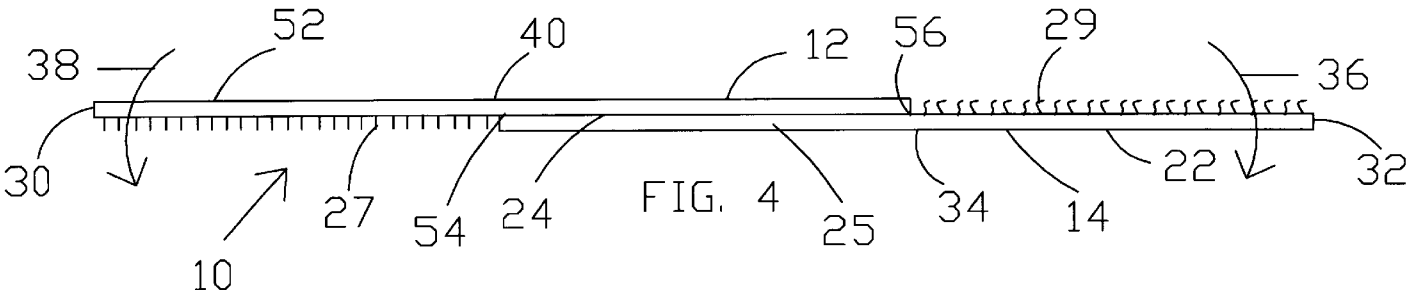
FIG. 4 is an elevational view showing a presently preferred construction of the shoe mountable identification assembly in accord with the present invention.
Figure 6:
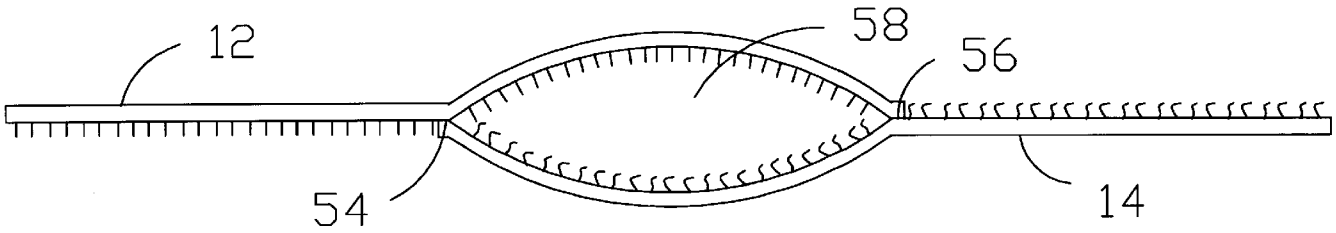
FIG. 6 is an elevational view showing the shoe mountable identification assembly of FIG. 4 opened at a connection portion to permit insertion of a shoe strap for one method of operation.
Figure 7:
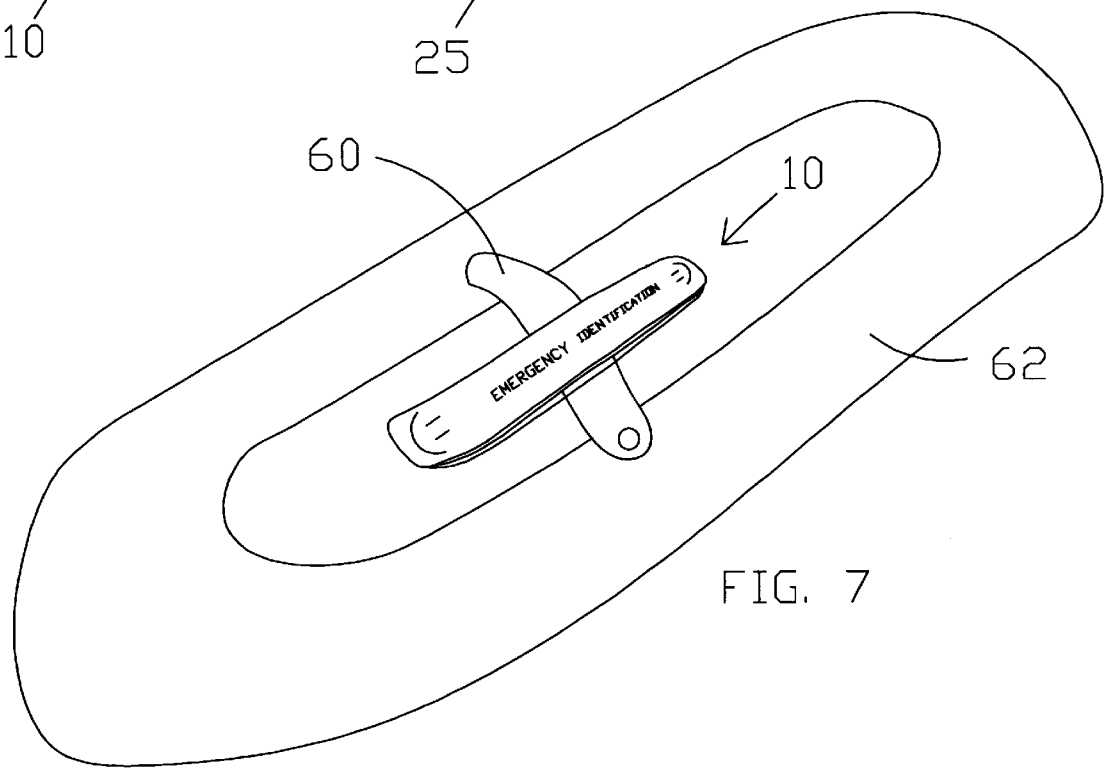
FIG. 7 is a perspective view of the shoe mountable identification assembly secured to a strap of a shoe.

FIG. 4 provides a side view of the presently preferred construction of shoe mounted identification assembly 10. As can be seen, a presently preferred construction requires only upper strip 12 and lower strip 14 which are permanently interconnected to form center region 25 which effectively is formed of both upper strip 12 and lower strip 14. In one embodiment of the invention center region 25, which may be temporarily connected together such as with hook and loop means or other means, may be opened as shown in FIG. 6 and FIG. 7, discussed hereinafter. Center region 25 is preferably the region that will be visible from above the shoe so that upper label 16 and pictures 18 may be positioned on an outer surface of center region 25. Center region 25 may be about the length of lacing on a child's shoe and may be about one and one-half to two and one-half inches in length.

As shown in FIG. 1 and FIG. 2, one side of one strip, which could be either upper strip 12 or lower strip 14, comprises hook fasteners 28. Likewise, one side of the opposing strip, comprises loop fasteners 26. Since hook and loop fasteners 26 and 28 could be used as opposites on either strip, hook fasteners 28 will be referred to a latching region 27 and loop fasteners 26 may be referred to as mating latching region 29. Many types of hook and loop connectors, such as VELCRO connectors, could be utilized to construct the presently preferred embodiment of the invention. Although as discussed below, the present invention is not limited to these types of connectors. In a preferred embodiment, as suggested above, connection 24 is not glued but may be held together with suitable fasteners and may then be opened as shown in FIG. 6.

Preferably at each end of center region 25, such as at connections 54 and 56 as shown most clearly in FIG. 6, glue, ultrasonic welding, or other means may be utilized with the hook and loop connectors to form an extremely strong and durable interconnection of upper strip 12 and lower strip 14. Although not the presently preferred embodiment, connection 24 could conceivably be connected along its length, if desired. Interconnection 24 and center region 25 are positioned midway or at least approximately between ends 30 and 32 of shoe mounted identification assembly 10.

In FIG. 6, one presently preferred embodiment of connection is shown whereby ultrasonic welding forms welds 54 and 56. In the example of FIG. 6, an opening 58 can be selectively opened as desired. Opening 58 can also be closed, preferably with the same VELCRO means on straps 12 and 14 discussed hereinbefore, but also with any other types of fasteners. Opening 58 may be opened to fit around a shoe strap, such as shoe strap 60 shown in FIG. 7 mounted to shoe 62. Thus, when shoe strap 60 is opened, then shoe mounted identification assembly 10 stays mounted on shoe 62. If additional straps are utilized in the shoe, then upper and lower strip 14 may loop around all the straps as well.

Upper strip 12 and lower strip 14 are preferably flexible but may preferably have a sufficient thickness so as to be stiff enough to be inserted through shoe lacing even if the shoe is being worn. However, much more flexible materials could also be utilized and it may typically be easier and more convenient to have the shoe removed, or at least have the laces or latches loose, when mounting the shoe mounted identification assembly 10. Various types of nylon, acrylic, and/or other materials, preferably water resistant materials, may be utilized to provide a reasonably stiff but readily bendable upper strip 12 and lower strip 14. However, the invention is not limited to such materials. In fact, rigid or stiff materials could be utilized along with one or perhaps multiple hinges to perform the method of the invention. As well, a combination of rigid and stiff materials could be utilized.

In the preferred embodiment, to interconnect ends 30 and 32, end 32 is folded, bent over, or rotated in a clockwise manner, as indicated by arrow 36 in FIG. 4, and lower strip 14 will bend or pivot generally around the area of bending or hinge area 34 because area 34 is much more flexible than the doubled thickness central region 25. Likewise, upper strip 12 may be folded, bent over, or rotated in a counterclockwise manner, as indicated by arrow 38 in FIG. 4, and upper strip 12 will bend or pivot generally around the area of bending or hinge area 40 because area 40 is much more flexible than the doubled thickness central region 25. It will be appreciated that latching regions 27 and mating latching region 29 must engage, so that as shown in the example of FIG. 4, after folding, latching region 27 will be on the outside and mating latching region 29 will be on the inside.

Figure 5:
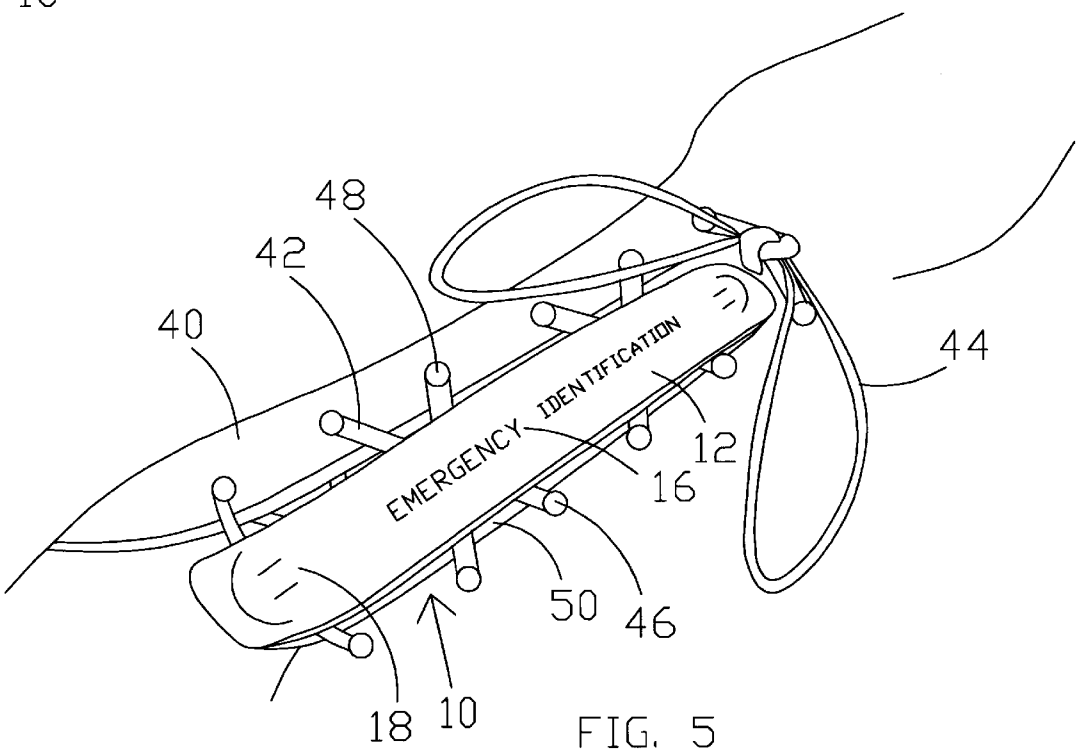
FIG. 5 shows an example of a shoe mountable identification assembly in position on a typical shoe in accord with the present invention.

FIG. 5 shows an embodiment with one possible means by which shoe mounted identification assembly 10 is mounted to shoe 40 with laces. It will be appreciated that shoe mounted identification assembly 10 would operate on shoes with laces or with other latching members such as VELCRO straps or other types of straps as are commonly utilized with children's shoes. Thus, for purposes of the present invention, shoe components will mean laces, straps, shoe tongue, or any latching means used on shoes. Thus, the present invention is adaptable to many different types of shoe constructions. Center region 25 is positioned above shoe laces 42. Ends 36 and 38, and latching regions 27 and 29, loop under the shoe laces 42 and above shoe tongue 50. Because latching regions 27 and 29 are sandwiched between shoe laces 42 and tongue 50, the latching regions are held in a connected position so that the mounting to the shoe is very secure. Note that while FIG. 5 shows that shoe mounted identification assembly 10 extends along the length of the laces 42. In a presently preferred embodiment, shoe mounted identification assembly does not cover knot 44 to thereby provide greater ease and convenience of operation. Shoe mounted identification assembly 10 does not have to cover all shoe laces but should simply be inserted through enough laces, at least two sets of laces or straps, to be securely mounted on shoe 42. For instance, if center region 25 formed of overlapping members is about two inches in length, this will typically be fine for most children's shoes. Moreover, the width of shoe mounted identification assembly 10 should be less than that the separation distance of lace eyelets, such as eyelets 46 and 48, on either side of shoe mounted identification assembly 10. Typically, the width will be less than one inch and may typically range from one-half inch to three-quarters inches.

While doubled center region 25 is on top of laces 42 in the preferred embodiment, shoe mounted identification assembly 10 could be rotated so that doubled center region 25 is below the laces. In this case, the position of upper label 16 with emergency identification notification thereon would need to be changed to be on outer surface 52 of upper member 12. One advantage of having doubled center region 25 on top of laces 42 is that the resulting sandwiching of latching areas 27 and 29 between the laces and the tongue provide such a strong lock that it is extremely unlikely the shoe mounted identification assembly 10 will come off or that children could remove it. Changing the position permits easier mounting and removal. This mounting method might be useful, for instance, at large theme parks, where the shoe mounted identification assembly 10 could be sold or rented at the gate, and may then be more quickly mounted and/or removed, if desired.

There are many alternative constructions of the present invention. Instead of hook and loop fasteners at fastening regions 27 and 29, buttons, snaps, zippers, clamps, or any other suitable fasteners could be utilized. Moreover, rigid members could be utilized. For instance, actual hinges or pivots could be provided at hinge regions 34 and 40. Effectively this construction would then comprise three rigid sections or members that operate in a similar manner as discussed above. However, two rigid sections or members that are hinged together on one side and fastenable to each other on the other side may be utilized to fold over with one rigid section above the tongue of a slip-on shoe and one rigid section below the tongue whereby the label 22 is provided on an inner surface. Two rigid sections or members could also be used that, instead of being hinged together, have fasteners/connectors on either side. In another embodiment, a single flexible member could be utilized whereby the member loops around the shoe laces or components and has a fastener of some type to close the loop. In fact, the present assembly is actually provided as a single flexible member comprising two flexible members permanently attached together. In yet another embodiment, a rigid member may be used with an attached flexible member. For instance the rigid member could go underneath the laces and the flexible fold over the top with a fastener for securing the same.

In another embodiment, a clip, which may be a metallic clip and may operate as a spring to clip to the shoes, may be utilized which may have a packet of soft material or a pocket mounted thereto for holding information which may be designed to slip over the rigid clip. If a clip is utilized, then the loop formed thereby may not be completely closed but instead may be mounted by spring force. Thus, one embodiment may effectively provide a clip that clips onto the latches or shoe tongue and, in this sense, loops around the shoe tongue.

While the present invention is discussed mainly in terms of children, persons, who may have memory problems, health problems, specific medical conditions, and the like, could also benefit from the present invention.

The foregoing disclosure and description of the invention is therefore illustrative and explanatory of one or more presently preferred embodiments of the invention and variations thereof, and it will be appreciated by those skilled in the art that various changes in the design, organization, order of operation, means of operation, equipment structures and location, methodology, and use of mechanical equivalents, as well as in the details of the illustrated construction or combinations of features of the various elements, may be made without departing from the spirit of the invention. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. As well, the relative size and arrangement of the components may be different from that shown and still operate well within the spirit of the invention as described hereinbefore and in the appended claims. It will therefore be clearly seen that various changes and alternatives may be used that are contained within the spirit of the invention. Moreover, it will be understood that various directions such as "upper," "lower," "bottom," "top," "left," "right," "inwardly," "outwardly," and so forth are made only with respect to easier explanation in conjunction with the drawings and that the components may be oriented differently, for instance, during transportation and manufacturing as well as operation. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

It is claimed:

1. A shoe mounted information carrying assembly for mounting on one or more shoe components, said one or more shoe components having an upper side and a lower side, said assembly comprising:

one or more members for looping around said upper side and said lower side of said plurality of shoe components to form a loop around said one or more shoe components for mounting to said shoe;

at least one fastener for securing said one or more members to provide that said closed loop is latched in a closed position for secure attachment to said shoe;

an information label mounted to said one or more members on an inner surface of said closed loop to provide detailed information about said wearer; and an outer label on an outer surface of said one more members mounted so as to be positioned above said upper side of said one or more shoe components, said outer label identifying said shoe mounted information carrying assembly as providing information related to said wearer.

2. The assembly of claim 1, wherein said at least one fastener comprises a hook and loop fastener.

3. The assembly of claim 1, wherein said one or more members comprises at least two flexible members permanently secured together to form a single member.

4. The assembly of claim 3, wherein said one or more members are permanently secured together to form a doubled region centrally positioned in said single member.

5. The assembly of claim 4, wherein said doubled region is joined on either end thereof and may be opened to receive at least one of said one or more shoe components.

6. The assembly of claim 4, wherein said outer label is formed on an outer surface of said doubled region.

7. A method for providing emergency identification information on a shoe of a wearer, comprising:

providing one or more members around an upper side and a lower side of one or more shoe components of said shoe such that an outer surface of said one or more members is visible above said one or more shoe components and an inner surface of said one or more members is not visible;

affixing said one or more members in position to said one or more shoe components;

providing emergency identification information on said inner surface of said one or more members whereby said emergency identification information is visible upon exposing said inner surface of said one or more members; and providing a label on said visible outer surface of said one or more members to indicate that emergency identification information is contained by said one or more members.

8. The method of claim 7, wherein said step of affixing further comprises utilizing one or more hook and loop fasteners to latchably affix said one or more members to said shoe.

9. The method of claim 7, further comprising:

permanently securing at least two members together.

10. The method of claim 9, wherein said step of providing one or more members around an upper side and a lower side of one or more shoe components further comprises:

providing that said at least two members are permanently secured at opposite ends of an overlap portion whereby said overlap portion can be opened to provide an opening for receiving at least one shoe latch.

11. The method of claim 10, wherein said step of permanently securing said at least two members further comprises ultrasonically welding said opposite ends of said overlap portion.

12. The method of claim 10, further comprising:

providing fasteners for said overlap portion for closing said opening in said overlap portion.

13. The method of claim 9, further comprising:

providing an overlap portion of said at least two members, and positioning said overlap portion directly above or directly below said one or more shoe components.

14. The method of claim 9, further comprising:

providing that a first of said at least two members have one side that is substantially covered with hooking fasteners, and providing that a second of said at least two members have one side that is substantially covered with loop fasteners.

15. A shoe mountable information carrying assembly operable for mounting on shoe components of a shoe of a wearer, said shoe components having an upper side and a lower side, said assembly comprising:

at least two members, a first member of said at least two members having a plurality of hook fasteners on one side of said first member, a second member of said at least two members having a plurality of loop fasteners on one side of said second member;

a permanent interconnection between said first member and said second member to form an elongate member operable to loop around said upper side and lower side of one or more of said shoe components to form a closed loop around one or more of said shoe components for mounting to said shoe, said permanent interconnection being comprised of overlapping portions of said loop fasteners and hook fasteners and being positioned in a middle region of said looping member;

a detailed information label mounted to an inner surface of said looping member to provide detailed information about said wearer.

16. The assembly of claim 15, further comprising:

a fastener for securing said elongate member formed from said hook fasteners and said loop fasteners, said fastener being operable to provide that said elongate member forms a closed loop for secure attachment to said shoe.

17. The assembly of claim 16, further comprising:

an outer label on an outer surface of said elongate member so as to be visible above said shoe to provide notification of said detailed information carried by said assembly.

18. The assembly of claim 16, wherein said elongate member is substantially flexible.

19. The assembly of claim 15, wherein said overlapping region may be selectively opened for receiving one or more of said shoe components.

* * * * *